US009495945B1

(12) United States Patent
George

(10) Patent No.: US 9,495,945 B1
(45) Date of Patent: Nov. 15, 2016

(54) GUITAR PAD FOR SEATED PLAYER

(71) Applicant: Michael A. George, Canastota, NY (US)

(72) Inventor: Michael A. George, Canastota, NY (US)

( * ) Notice: Subject to any disclaimer, the term of this patent is extended or adjusted under 35 U.S.C. 154(b) by 0 days.

(21) Appl. No.: 14/953,532

(22) Filed: Nov. 30, 2015

(51) Int. Cl.
*G10G 5/00* (2006.01)

(52) U.S. Cl.
CPC ..... *G10G 5/005* (2013.01)

(58) Field of Classification Search
CPC ..... G10G 5/005; G10G 5/00; G10D 3/18; G10D 1/005; F16M 13/00
USPC ..... 84/327, 329
See application file for complete search history.

(56) References Cited

U.S. PATENT DOCUMENTS

| | | | | |
|---|---|---|---|---|
| 3,979,993 | A | 9/1976 | Proctor | |
| 4,966,062 | A | 10/1990 | Driggers et al. | |
| 5,388,492 | A | 2/1995 | Olson | |
| 5,508,084 | A | 4/1996 | Reeves et al. | |
| 6,005,175 | A | 12/1999 | Johnson | |
| 6,031,167 | A | 2/2000 | Gaston | |
| 6,143,964 | A | 11/2000 | Chen | |
| 6,252,150 | B1 | 6/2001 | Johnson | |
| 6,383,607 | B1 | 5/2002 | Shin | |
| 6,576,823 | B1 | 6/2003 | Wise, Jr. | |
| 7,205,468 | B1 | 4/2007 | Johnson | |
| 7,323,627 | B2 | 1/2008 | Sweeney | |
| 7,420,108 | B1 | 9/2008 | Block | |
| 7,524,778 | B2 | 4/2009 | Sobonya et al. | |
| 7,732,689 | B1 | 6/2010 | Jiang et al. | |
| 8,110,270 | B2 | 2/2012 | Wheatley | |
| 2003/0217635 | A1* | 11/2003 | Christou | G10G 5/005 84/327 |
| 2008/0196572 | A1* | 8/2008 | Navarro | G10G 5/005 84/327 |

OTHER PUBLICATIONS

Zerust, Toolbox Liners—Tool box Drawer Liners (web page); http://www.zerustproducts.com/products/tool-tackle-box-rust-control/—Aug. 2009.

* cited by examiner

*Primary Examiner* — Kimberly Lockett
(74) *Attorney, Agent, or Firm* — Bernhard P. Molldrem, Jr.

(57) ABSTRACT

A guitar pad is designed to support a guitar or similar stringed instrument on the lap of a seated player, and the body portion rests on the pad when it is draped over on one of the player's legs. This facilitates the player maintaining proper posture and positioning when playing the instrument. The guitar pad is formed of a single-thickness piece of a flexible non-adhesive grip material formed of a woven scrim on which beads of a low-slip resin are positioned to alternate with open spaces; and a frame or border affixed onto the edge of the grip material. The frame or border may be formed of a narrow strip or strips of a low-stretch flexible material, e.g., leather or synthetic leather.

9 Claims, 3 Drawing Sheets

GUITAR PAD FOR SEATED PLAYER

BACKGROUND OF THE INVENTION

This invention relates to devices to aid a guitar player or other instrumentalist in maintaining a proper and comfortable posture while playing a guitar or similar string instrument. The invention is more particularly concerned with a pad or cushion to assist the player in maintaining the guitar or other instrument in proposer position with the body of the guitar resting on the musician's upper leg when the musician is in a seated position.

The classical acoustic guitar, that is, an instrument based on the traditional Spanish guitar, is typically played while seated and with the instrument placed on the thigh of the player's left leg. The left foot is typically supported on a footstool or block to bring the guitar to a position central to the musician's torso, with the guitar turned slightly to the right and resting against the player's ribs at his or her right side. The seating posture is critical to the playing position, in order to achieve physical stability of the instrument; freedom of both the right and left hands so they can meet the technical demands of playing music, without having to be occupied with supporting the instrument or keeping it properly oriented; and elimination of any undue stress or tension to the musician while in the playing position.

A number of guitar support devices have been proposed to assist the classic guitar player in this regard. Guitar supports have been proposed with straps or cushions to rest on the player's leg and with a frame or other member that rises above the leg strap or cushion to hold the instrument at an elevated position. Typical examples of these are presented in Jiang et al. U.S. Pat. No. 7,732,689; Johnson U.S. Pat. No. 6,252,150; Olson U.S. Pat. No. 5,388,492; Driggers et al. U.S. Pat. No. 4,966,062; and Proctor U.S. Pat. No. 3,979,933. These devices have been difficult or clumsy to use and have not become popular. An L-shaped cushion or support pad for a guitar or other stringed instrument for relieving pain from contact with the instrument is shown in Gaston U.S. Pat. No. 6,031,167. This device is rather bulky and may need to be adjusted to the player. Also, none of the foregoing approaches have paid any attention to the need to maintain free ventilation of air to the player's leg and to permit perspiration vapor from the player's leg to be vented away freely.

OBJECTS AND SUMMARY OF THE INVENTION

According to an aspect of the present invention, a thin, flexible and resilient guitar pad, which is also easily washable and can be stored in the musician's guitar case with the instrument, is designed for the guitarist to support his or her instrument on the lap, i.e., on one or the other thigh, and to help maintain the instrument in the proper position for playing music.

It is an important objective to provide a guitar pad that can be used with a guitar or other stringed instrument, and which avoids the drawbacks of the prior art.

In accordance with an important aspect of this invention, a guitar pad is particularly adapted for supporting a guitar or similar stringed instrument on the lap of a seated player. The instrument typically has a hollow body portion and a neck with a fingerboard for the left hand A surface if the instrument body portion is positioned and supported on one of the player's legs when playing the instrument. To this end, the guitar pad is formed of a single-thickness piece of a flexible non-adhesive grip material formed of a woven scrim on which beads of a low-slip resin are positioned to alternate with open spaces. This piece of grip material (which can be square or oblong, or can be round or oval or another shape) has an edge portion that extends around its periphery. A border or frame is affixed, e.g., sewn, onto the edge portion, the frame being formed of a narrow strip or strips of a low-stretch flexible material such as leather or a simulated leather.

In a preferred example, the grip material has beads of the low-slip resin that each have a thickness of about ⅛ inch and length and width of about ⅛ inch, with the open spaces each having a length and width of about ⅛ inch. The grip material can be in the shape of a rectangle having length and width dimensions each between about ten and fourteen inches, e.g., twelve-by-twelve inches. The border or frame can have a width of about one-inch when affixed to the edge portion. The grip material and the border are washable, and so the guitar pad can be easily rinsed and cleaned. The beads and open space provide ventilation to the player's thigh so his or her leg remain relatively cool and dry during guitar play or practice. The grip material also keeps the guitar body from slipping and likewise maintains its position on the players trouser leg.

The guitar pad can be kept as simple as possible, as the pad allows the guitarist to support the instrument directly on the leg, with only the guitar pad between the instrument and his or her leg. Accordingly, guitar pad consisting essentially of the single thickness square of non-adhesive grip material formed of a woven scrim on which the beads of a low-slip resin are positioned to alternate with open spaces; and the frame of flexible material that is sewn of otherwise affixed onto the edge portion of the square of the grip material. No other supports or hardware or pads are required. The material can be of any of numerous colors. A brand or a personalization can be printed or formed on the pad, or on the frame. As mentioned before, the beads can each have a thickness of about ⅛ inch and length and width of about ⅛ inch, with open spaces each having a length and width of about ⅛ inch. This can vary somewhat, so long as it provides some cushioning and good non-slip properties. The square can have length and width dimensions of about twelve inches. The frame can be made of a leather or leatherette (synthetic leather) material, with the frame having a width of about one inch.

The invention is also concerned with the method of using this guitar pad in holding the instrument in place while playing. That is, another aspect of the invention concerns the method of playing an acoustic guitar or similar stringed instrument wherein a surface of a body portion of the guitar or similar stringed instrument rests on one leg (usually the left leg) of the player when seated. Thus, the method involves the player taking a seated position, and placing on the thigh of one or the other leg the guitar pad, as described, placing the guitar or similar stringed instrument at a position such that said surface of the body portion is supported on the guitar pad on the one leg of the player, and then playing the guitar. In this case, the guitar pad consists essentially of the single thickness square of flexible, non-adhesive grip material formed of a non-woven scrim on which beads of a low-slip resin are positioned to alternate with open spaces, the beads and open spaces each having a dimension of about one-eighth inch, and the square of grip material having an edge portion that extends around all four sides thereof, and the frame formed of narrow strip or strips of a low-stretch flexible material affixed onto the edge portion along all four sides.

These and other objects, features, and advantages of the invention will become apparent from the following detailed description of selected preferred embodiments, which is to be read in connection with the accompanying Drawing:

DETAILED DESCRIPTION OF THE PREFERRED EMBODIMENT

Figure 1:
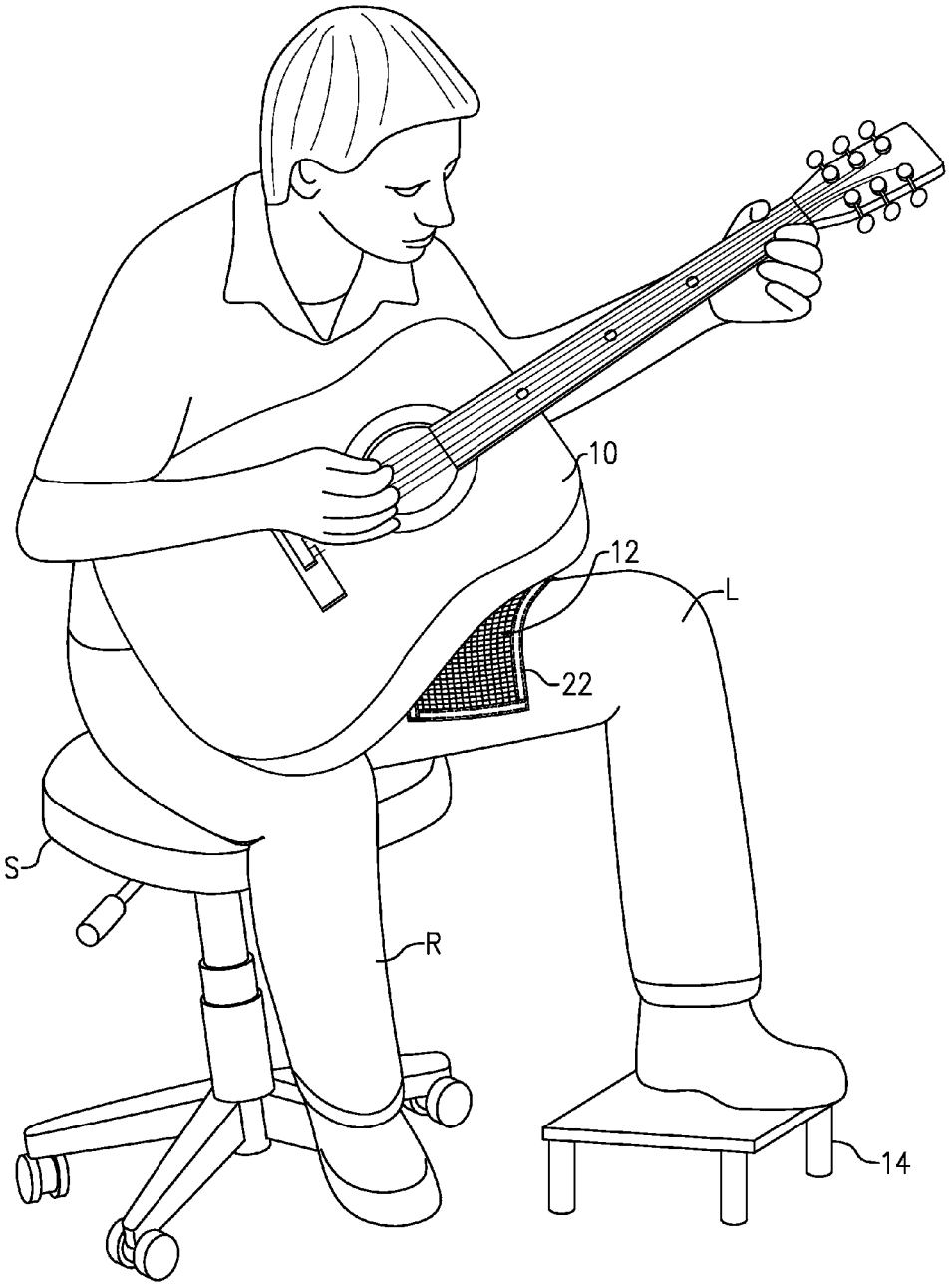
FIG. 1 is a perspective view of a guitarist holding his instrument in a proper playing position, with the guitar supported on the left leg, and using a guitar pad according to an embodiment of this invention.
Figure 2:
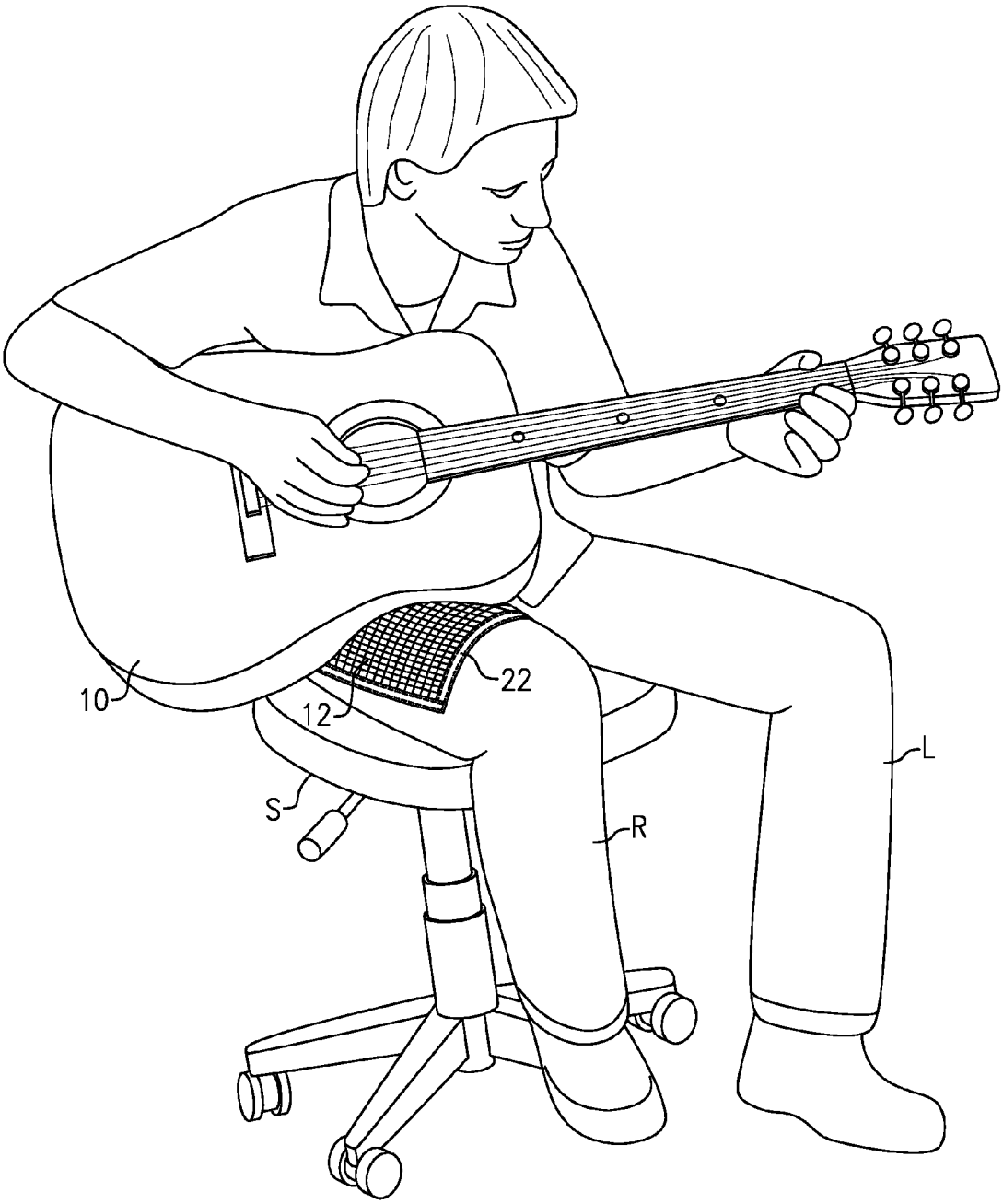
FIG. 2 is a perspective view of the guitarist holding his instrument in an alternate playing position, with the guitar supported on the right leg, and using the guitar pad of this embodiment.

With reference to the FIGS. 1, 2, 3 and 3A of the Drawing Figures, a guitar player is shown in FIG. 1 holding an acoustic Spanish or classical guitar 10, with a body of the guitar supported on the player's left leg L. Here a guitar pad 12 of an embodiment of this invention is draped over the players left thigh, with a surface of the guitar body resting on the pad 12. The guitar player is seated on a stool S with his left foot resting on a foot stool 14, and with the player's right leg tucked beneath the seat of the stool S. As shown in FIG. 2, the guitar player may prefer an alternate playing position in which the guitar body rests on the pad 12 on the player's right leg R. In another alternative position, not shown, the player may have the back of the guitar body 10 and neck of the instrument resting on one or both legs, with the guitar pad 12 on one leg or the other. This alternative position is sometimes used with resonator or Dobro-style guitars when they are played as slide guitars.

Figure 3:
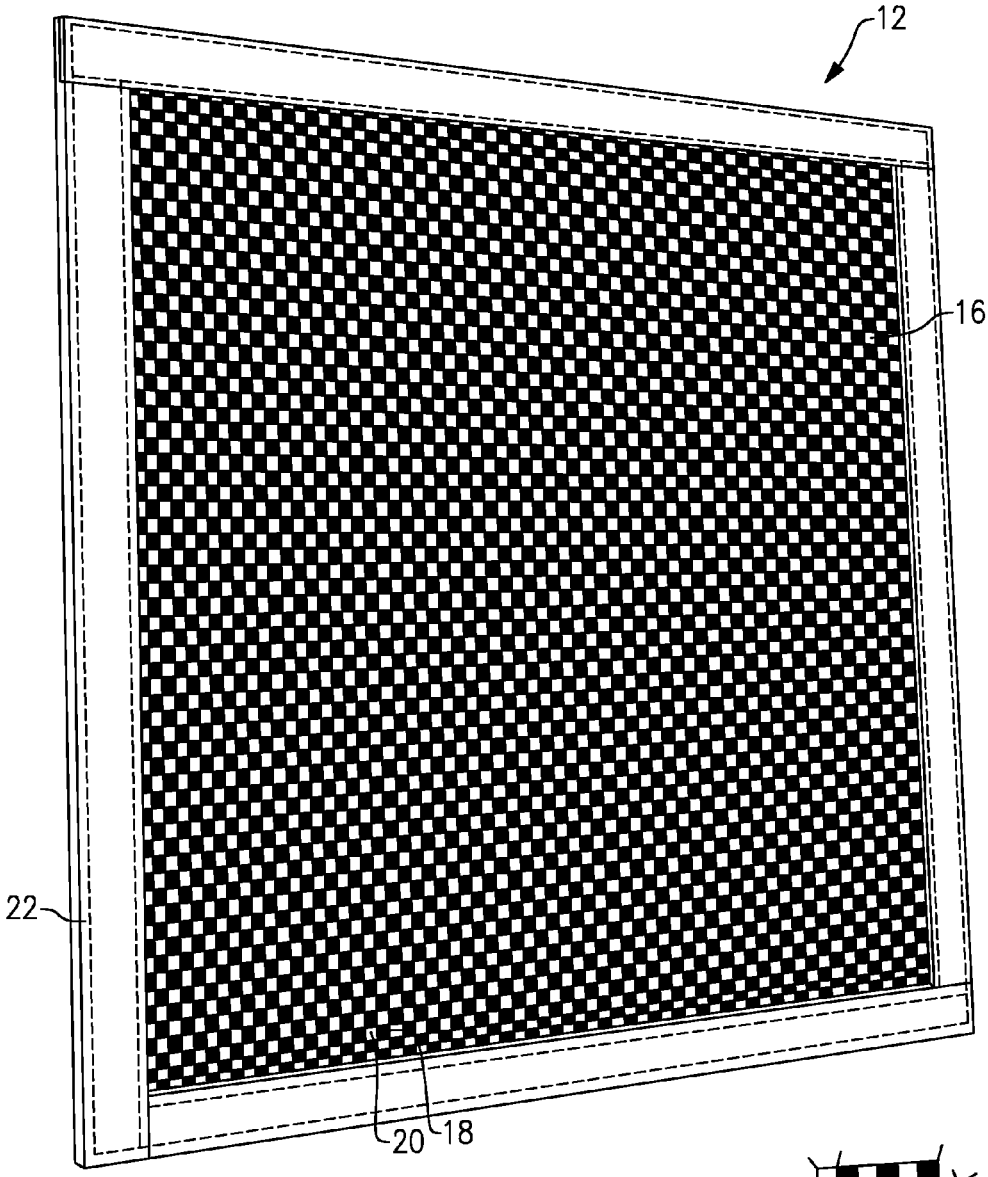
FIG. 3 is a plan view of the guitar pad of this embodiment.
Figure 3A:
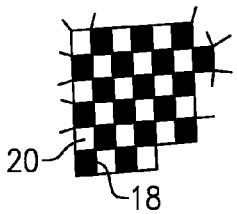
FIG. 3A is an enlarged partial view of the non-slip grip material employed in this embodiment.

FIG. 3 shows a practical example of the guitar pad 12, formed of a square 16 of non-adhesive grip material, with a frame or margin 22 of leather or a simulated leather material sewn all around its periphery. A shown in FIGS. 3 and 3A, the square 16 of non-adhesive, low-slip grip material is in the form of rows and columns of beads 18 of low-slip resin material that alternate with open spaces 20. Here, the beads and open spaces are each about one-eighth inch long and wide, and the beads 18 are also about one-eighth thick. The beads 18 are supported on a network or scrim 24 of threads or fibers the extend horizontally and vertically. The size of the beads 18 and spaces 20 ensure that the guitar is adequately cushioned for having the guitar player rest the instrument on his leg for an extended period of time, and that the guitar and pad do not slip relative to the player's leg.

The invention has been shown and described in connection with the play of a classical or Spanish guitar. However, the guitar pad could be used favorably with other types of string instruments, e.g., banjo, mandolin, ukulele, etc.

While the present invention has been described with reference to a certain preferred embodiment, it should be understood that the invention is not limited to that precise embodiment. Rather, many modifications and variations would present themselves to persons skilled in the art without departure from the scope and spirit of this invention, as defined in the appended claims.

What is claimed is:

1. Guitar pad for supporting a guitar or similar stringed instrument on a lap of a seated player, where the instrument has a body portion with a surface that is to be positioned and supported on one leg of the seated player when playing the instrument, the guitar pad comprising:

a single-thickness piece of a flexible non-adhesive grip material formed of a woven scrim on which beads of a low-slip resin are positioned to alternate with open spaces, the piece of grip material having an edge portion that extends around a periphery of the piece of grip material; and a frame affixed onto said edge portion, said frame being formed of a narrow strip or strips of a low-stretch flexible material.

2. Guitar pad according to claim 1 wherein said beads of said low-slip resin each have a thickness of about ⅛ inch and length and widths of about ⅛ inch, and wherein said open spaces each have length and width of about ⅛ inch.

3. Guitar pad according to claim 2 wherein said piece of grip material is formed as a rectangle having length and width dimensions each between about ten and fourteen inches.

4. Guitar pad according to claim 1 wherein said strip or strips of a low-stretch flexible material include leather strips which have a width of about one-inch when affixed to said edge portion.

5. Guitar pad for supporting a guitar or similar stringed instrument on a lap of a seated player where the instrument has a body portion with a surface that is positioned and supported on one leg of the seated player, the guitar pad consisting essentially of a single thickness square of a non-adhesive grip material formed of a woven scrim on which beads of a low-slip resin are positioned to alternate with open spaces, the square of grip material having an edge portion that extends along each of four sides thereof; and a frame affixed onto said edge portion, said frame being formed of a narrow strip or strips of a low-stretch flexible material.

6. The guitar pad according to claim 5 wherein said beads each have a thickness of about ⅛ inch and length and width of about ⅛ inch, with said open spaces each having a length and width of about ⅛ inch.

7. The guitar pad according to claim 5 wherein said square of a non-adhesive grip material has a length and width each of about twelve inches.

8. The guitar pad according to claim 5 wherein the strip or strips of said frame are a leather or leatherette material, with the frame having a width of about one inch.

9. A method of playing an acoustic guitar or similar stringed instrument wherein a surface of a body portion of the guitar or similar stringed instrument rests on one leg of a player when the player is seated, the method comprising:

the player taking a seated position;

placing on a thigh of said one leg of the player a guitar pad, the guitar pad consisting essentially of a single thickness square of a flexible, non-adhesive grip material formed of a non-woven scrim on which beads of a low-slip resin are positioned to alternate with open spaces, the beads and open spaces each having a dimension of about one-eighth inch, and the square of grip material having an edge portion that extends around all four sides thereof, and a frame formed of narrow strip or strips of a low-stretch flexible material affixed onto said edge portion along each of four sides thereof;

placing the guitar or similar stringed instrument at a position such that said surface of the body portion is supported on said guitar pad on said one leg of the player.

* * * * *